US007320488B2

(12) United States Patent
Hidding et al.

(10) Patent No.: US 7,320,488 B2
(45) Date of Patent: Jan. 22, 2008

(54) LATCH ASSEMBLY

(75) Inventors: Matthew L. Hidding, Elma, IA (US); Gene C. Light, Denver, IA (US); Tyler G. Larsen, Sumner, IA (US); Kelly F. Mishak, Alta Visa, IA (US)

(73) Assignee: Tri/Mark Corporation, New Hampton, IA (US)

( * ) Notice: Subject to any disclaimer, the term of this patent is extended or adjusted under 35 U.S.C. 154(b) by 131 days.

(21) Appl. No.: 10/874,080

(22) Filed: Jun. 22, 2004

(65) Prior Publication Data

US 2006/0006667 A1 Jan. 12, 2006

(51) Int. Cl.
*E05C 3/06* (2006.01)

(52) U.S. Cl. ..... 292/216; 292/DIG. 41

(58) Field of Classification Search ..... 292/216, 292/201, 337, DIG. 41; D8/343
See application file for complete search history.

(56) References Cited

U.S. PATENT DOCUMENTS 5,564,295 A * 10/1996 Weinerman et al. ..... 70/208
6,139,073 A * 10/2000 Heffner et al. ..... 292/201
6,629,710 B1 * 10/2003 Shafry et al. ..... 292/216
2005/0206172 A1 * 9/2005 Bacon ..... 292/216

* cited by examiner

*Primary Examiner*—Gary Estremsky
(74) *Attorney, Agent, or Firm*—Wood, Phillips, Katz, Clark & Mortimer

(57) ABSTRACT

A latch assembly having a housing and a catch assembly on the housing and having first and second states. The catch assembly has a rotor that is movable selectively relative to the housing between first and second positions. The rotor has a mounting portion and a receiving portion. The receiving portion has a U-shaped opening between spaced first and second legs. The U-shaped opening is configured to receive a strike element. The latch assembly further has a strike plate with a strike surface that projects across the U-shaped opening to block a strike element in the U-shaped opening with the rotor in the first position and the catch assembly in the first state. The U-shaped opening is bounded by an edge with a portion of the edge defined by the first leg against which a strike element within the U-shaped opening bears under a force tending to separate the latch assembly from the strike element. A portion of the edge has a first substantially straight length that extends to adjacent the strike surface with the rotor in the first position. The rotor is in the second position with the catch assembly in the second state to allow a strike element in the U-shaped opening, with the latch assembly in the first state, to be separated form the latch assembly.

30 Claims, 6 Drawing Sheets

LATCH ASSEMBLY

BACKGROUND OF THE INVENTION

1. Field of the Invention

This invention relates to latch assemblies as used on repositionable elements, such as closure elements, and, more particularly, to a latch assembly having a catch assembly which is releasably engageable with a strike element to maintain the closure element in at least one predetermined position relative to a support for the closure element.

2. Background Art

Latch assemblies are utilized in myriad different environments for both static and dynamic applications. In one exemplary latch assembly, a catch assembly is provided within a component space defined by a housing. The catch assembly has at least first and second different states. The catch assembly includes a rotor that is in a first, primary latched position with the catch assembly in the first state and a second position with the catch assembly in the second state. In the first position, the rotor engages a strike element so as to prevent separation of the strike element from the latch assembly. With the rotor in the second position, the strike element, which is held by the latch assembly with the rotor in the first position, is permitted to be separated from the latch assembly. The rotor commonly has a third, secondary latched position, between the first and second rotor positions. With the rotor in the third position, the latch assembly is in a third state, wherein the rotor engages the strike element to prevent separation of the strike element from the latch assembly.

The rotor has a U-shaped opening to receive the strike element. With the rotor in the first position, and the strike element within the rotor opening, escape of the strike element is prohibited by a strike surface on a strike plate which blocks the rotor opening by bridging two spaced legs between which the strike element moves. With the strike element engaged by the latch assembly, and a closure element with which the latch assembly is associated in a first position, attempted movement of the closure element from the first position into a second position therefor causes a force to be imparted by the strike element through the rotor and strike plate to the housing. It is important that the housing does not respond to this force by bending/deflecting to the point that the strike element might escape from between the rotor and strike plate. In certain applications, such as on moving vehicle doors, the forces tending to compromise the connection of the latch assembly and strike element may be substantial. Aside from the fact that the magnitude of these forces may be quite large, governmental regulations often impose stringent requirements on the ability of these latch assemblies to resist forces even greater than those typically encountered.

Conventionally, the relationship between a strike element and rotor, with the rotor in the first position therefor, is characterized as being either "in pocket" or "out of pocket". The in pocket relationship occurs with the captive strike element bearing against one arm on the rotor and remaining spaced from the strike surface on the strike plate. That is, the strike element penetrates the U-shaped opening sufficiently that with the rotor in the first position therefor, the strike element remains spaced from the strike surface on the strike plate. As the force generated on the first arm by the strike element increases, as in the event that the closure element is urged forcibly from the first position towards the second position therefor, a deflection/bending of the housing may occur to the point that the strike element bears simultaneously against the first arm of the rotor and the strike surface on the strike plate. This results in the strike element being out of pocket. For a typical construction, the ability of the latch assembly to withstand additional loading is greater with the strike element in the in pocket state then in the out of pocket state. Thus, ideally, the latch assembly design takes into consideration the maintenance of the in pocket state to the highest loading anticipated. This objective, however, may compete with that of rigidifying the housing without increasing its perimeter dimensions. The industry continues to seek out designs which improve overall strength without dimensional variations for the housing.

SUMMARY OF THE INVENTION

In one form, the invention is directed to a latch assembly having a housing and a catch assembly on the housing and having first and second states. The catch assembly has a rotor that is movable selectively relative to the housing between first and second positions. The rotor has a mounting portion and a receiving portion. The receiving portion has a U-shaped opening between spaced first and second legs. The U-shaped opening is configured to receive a strike element. The latch assembly further has a strike plate with a strike surface that projects across the U-shaped opening to block a strike element in the U-shaped opening with the rotor in the first position and the catch assembly in the first state. The U-shaped opening is bounded by an edge with a portion of the edge defined by the first leg against which a strike element within the U-shaped opening bears under a force tending to separate the latch assembly from the strike element. A portion of the edge has a first substantially straight length that extends to adjacent the strike surface with the rotor in the first position. The rotor is in the second position with the catch assembly in the second state to allow a strike element in the U-shaped opening, with the latch assembly in the first state, to be separated form the latch assembly.

In one form, the strike surface extends along a reference line and the straight length of the edge portion is spaced from the reference line a distance not greater than on the order of 0.04 inches with the rotor in the first position.

In one form, the first leg defines a confronting edge which faces and is at or adjacent the strike surface with the rotor in the first position. The conforming edge has a second substantially straight length, with the first and second substantially straight lengths converging towards a corner.

In one form, the corner is convexly radiused.

The corner may be defined by an arc of a circle having a radius of from 0.024 to 0.04 inches.

In one form, the radius of the arc is not greater than on the order of 0.032 inches.

In one form, the first leg has a confronting edge at or adjacent to the strike surface with the rotor in the first position and the confronting edge and the portion of the edge meet at a corner having a convex shape approximated by an arc of a circle having a radius that is substantially less than 0.125 inch.

The latch assembly may be provided in combination with a repositionable element to which the latch assembly is attached. The repositionable element has a strike element thereon and is movable between first and second positions relative to a support. With the repositionable element in the first position, the latch assembly is in the first state and the strike element captively resides within the U-shaped opening.

In one form, the first leg is abuttable to the strike surface.

The invention is further directed to a latch assembly having a housing and a catch assembly on the housing and having first and second states. The catch assembly has a rotor that is movable selectively relative to the housing between first and second positions. The rotor has a mounting portion and a receiving portion. The receiving portion has a U-shaped opening between spaced first and second legs. The U-shaped opening is configured to receive a strike element. The latch assembly further has a strike plate with a strike surface which projects across the U-shaped opening to block a strike element in the U-shaped opening with the rotor in the first position and the catch assembly in the first state. The U-shaped opening is bounded by an edge with a portion of the edge defined by the first leg against which a strike element with a U-shaped opening bears under a force tending to separate the latch assembly from the strike element. The first leg has a confronting edge at or adjacent to the strike surface with the rotor in the first position. The portion of the edge and the confronting edge meet at a corner having a convex shape approximated by a radius that is substantially less than 0.125 inch. The rotor is in the second position with the catch assembly in the second state, to allow a strike element in the U-shaped opening, with the latch assembly in the first state, to be separated from the latch assembly.

In one form, the edge portion on the first leg extends to within 0.04 inches of the strike surface.

The confronting edge may have a substantially straight length extending along a first line.

In one form, the strike surface extends along a reference line and the first line is substantially parallel to the reference line.

The convex shape of the corner may be approximated by an arc of a circle having a radius that is not greater than 0.04 inches.

In one form, the convex shape of the corner is approximated by an arc of a circle having a radius that is in the range of 0.024 to 0.04 inches.

The convex shape of the corner may be approximated by an arc of a circle having a radius that is on the order of 0.032 inches.

The latch assembly may be provided in combination with a repositionable element to which the latch assembly is attached. The repositionable element is movable between first and second positions relative to a support. With the repositionable element in the first position, the latch assembly is in the first state and the strike element captively resides within the U-shaped opening.

The first leg may be abuttable to the strike surface.

The invention is further directed to a rotor for use in a latch assembly having a housing and a strike plate with a strike surface. The rotor is movable between first and second positions to respectively hold a strike element and allow separation of a strike element from the rotor. The rotor has a body with a mounting portion and a receiving portion. The receiving portion has first and second legs between which an opening is defined that is bounded by a U-shaped edge. The U-shaped edge is defined by an edge portion on the first leg. The first leg has a confronting edge which is repositionable at or adjacent to a strike surface with the rotor in the first position. A portion of the edge and the confronting edge meet at a corner having a convex shape approximated by a radius that is substantially less than 0.125 inch.

In one form, the edge portion has a substantially straight length that extends to the corner.

In one form, the confronting edge has a substantially straight length.

The convex shape of the corner may be approximated by an arc of a circle having a radius that is not greater than 0.04 inches.

In one form, the convex shape of the corner is approximated by an arc of a circle having radius that is in the range of 0.024 to 0.04 inches.

The convex shape of the corner may be approximated by an arc of a circle having a radius that is on the order of 0.032 inches.

DETAILED DESCRIPTION OF THE DRAWINGS

Figure 1:
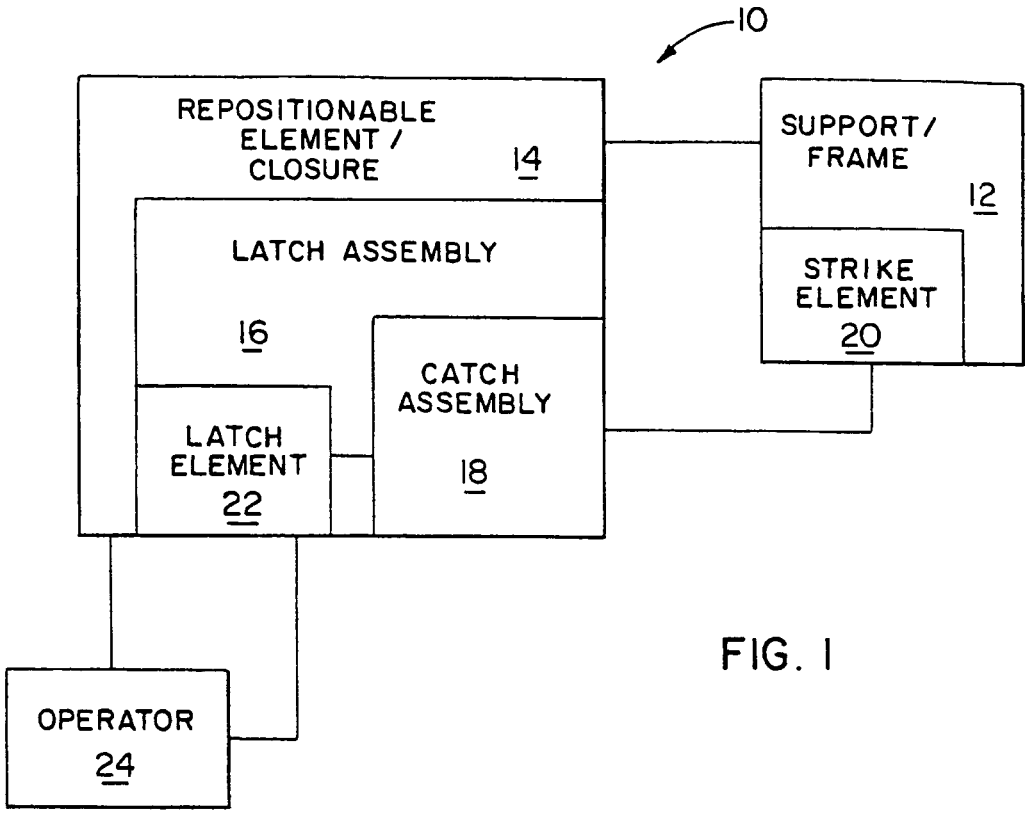
FIG. 1 is a schematic representation of a system including a repositionable element/closure mounted movably upon a support/frame and including a latch assembly, according to the present invention, which cooperates with a strike element on the support/frame to releasably maintain the repositionable element/closure in at least one predetermined position.
Figure 2:
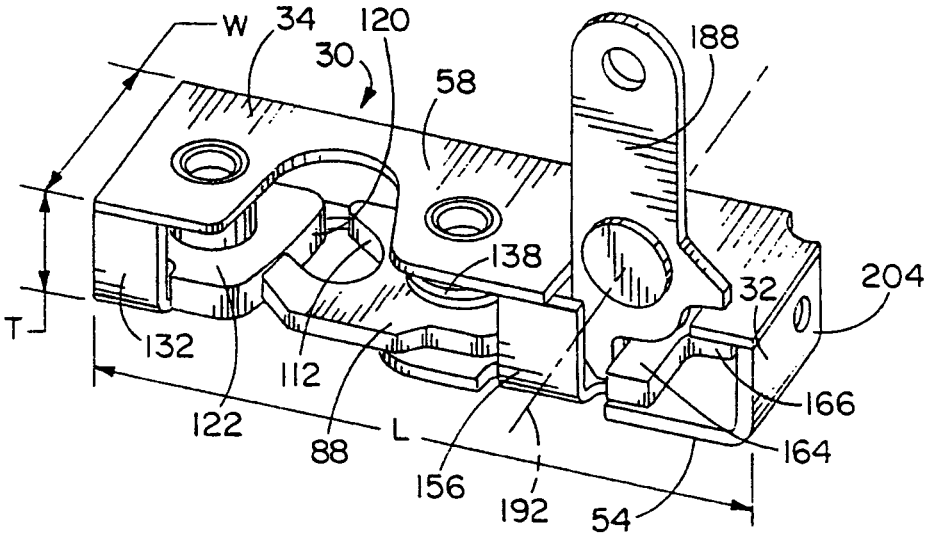
FIG. 2 is a perspective view of one form of the inventive latch assembly on the system in FIG. 1 and including a multi-part housing with a catch assembly having a rotor that is movable between first, second, and third positions, corresponding to first, second, and third different states for the catch assembly, to selectively hold and release the strike element, and with the rotor in the first position, which is a primary latched position.
Figure 3:
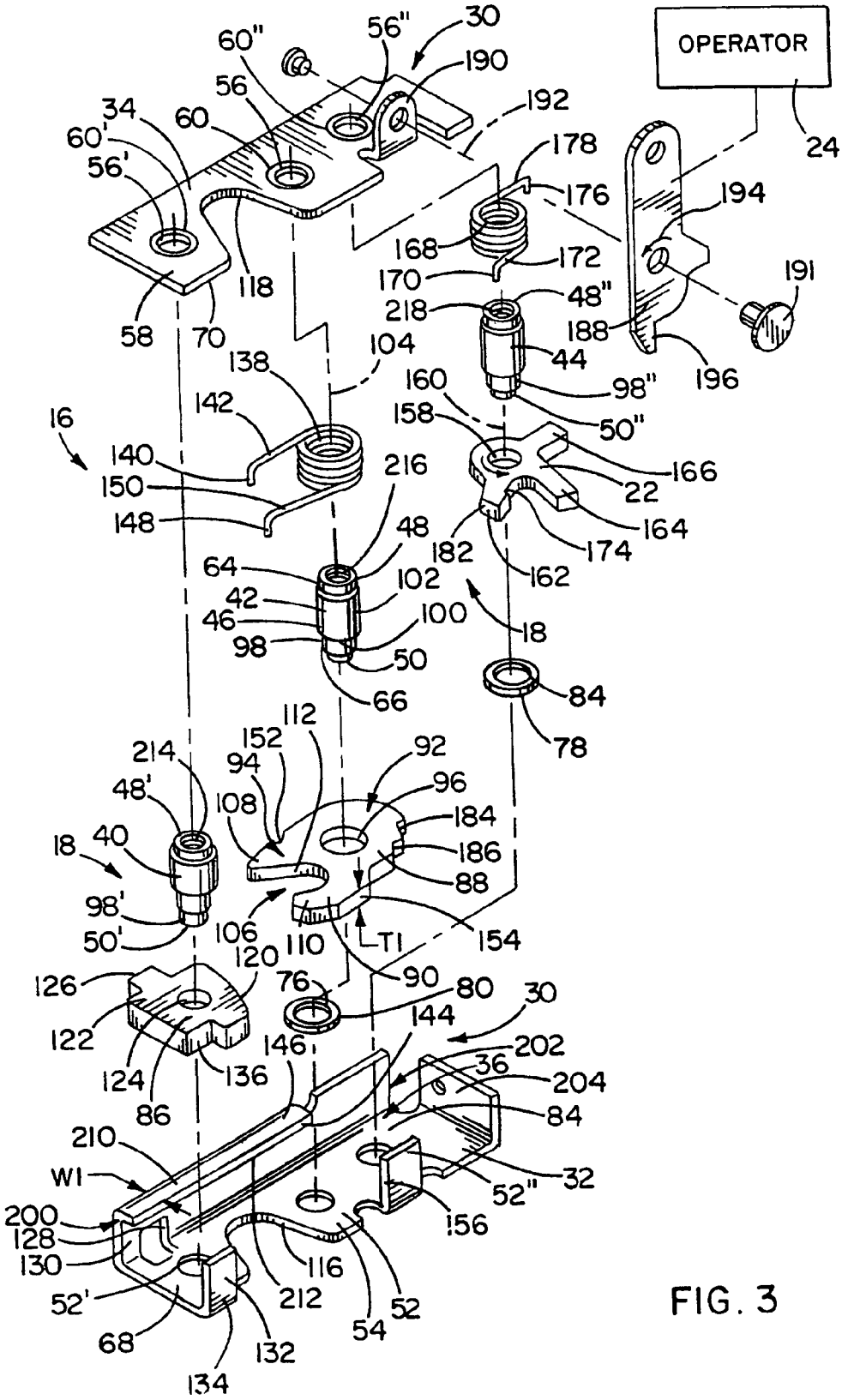
FIG. 3 is a reduced, exploded, perspective view of the inventive latch assembly in FIG. 2.
Figure 4:
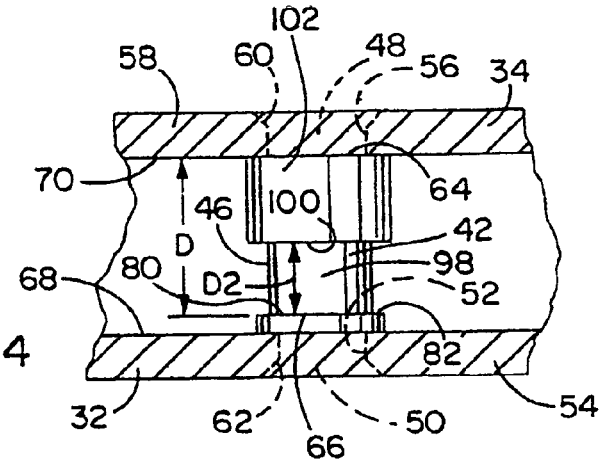
FIG. 4 is an enlarged, fragmentary, partial cross-sectional, view of a connection between an axle and two housing parts on the latch assembly in FIG. 2.

In FIG. 1, an exemplary system, which represents a suitable environment for the present invention, is shown at 10. The system 10 consists of a support/frame 12 on which a repositionable element 14 is attached for selective movement between first and second different positions. The system 10 may be in either a static or dynamic environment. As one example, the support/frame 12 may be a fixed structure, such as a building or a stationary cabinet. The repositionable element 14 may be in the form of a closure, or virtually any element which is required to be placed in two different positions in normal operation.

According to the invention, the repositionable element/closure 14 has a latch assembly 16 carried thereon with a catch assembly 18 that cooperates with a strike element 20 on the support/frame 12. The latch assembly 16 is designed to releasably maintain the repositionable element/closure 14 in its first position with the latch assembly 16 in a first state. By changing the latch assembly 16 into a second state, the strike element 20 can be released from the catch assembly 18 to allow the repositionable element/closure 14 to be placed in its second position. The latch assembly 16 has a latch element 22 that is movable between a latched position and a release position through an operator 24 to respectively a) maintain the catch assembly 18 in the first state and b) allow the catch assembly 18 to be changed from the first state into the second state.

As shown more specifically in FIGS. 2-7, the latch assembly 16 has a housing 30 defined by joinable first and second housing parts 32, 34 which are joined to cooperatively define a component storage space at 36 for, in this case, the catch assembly at 18. The housing 30 has a generally squared/rectangular perimeter shape with a length (L), a width (W) and a thickness (T). The precise shape of the housing 30 is not critical to the present invention.

The housing parts 32, 34 are maintained in fixed relationship by, in this embodiment, three similarly configured axles 40, 42, 44. Exemplary axle 42 has a cylindrical body 46 and axially spaced, reduced diameter ends 48, 50, as shown most clearly in FIGS. 3 and 4. The end 50 is directed through a bore 52 through a base wall 54 on the housing part 32. The other end 48 extends through a bore 56 in a cover wall 58 defining the second housing part 34. The bore 56 has a surrounding bevel 60 with the bore 52 having a like surrounding bevel 62.

The reduced diameter ends 48, 50 define oppositely facing, annular shoulders 64, 66 which are spaced a distance D to establish the desired spacing between a flat surface 68 on the base wall 54 and a facing flat surface 70 on the cover wall 58, with the latter abutting to the shoulder 64 with the housing 30 assembled. The axle ends 48, 50 are radially deformed, through a swaging process, or otherwise, to conform them to the beveled surfaces 60, 62 in such a manner that the base wall 54 and cover wall 58 are drawn tightly towards each other and against the shoulders 64, 66, respectively, to unitize the axle 42 and housing parts 32, 34.

The axle 40 has a stepped outer diameter and reduced diameter ends 48', 50' which extend through bores 56', 52', with surrounding bevels 60' (one shown), on the cover wall 58 and base wall 54, respectively.

The axle 44 also has a stepped outer diameter with reduced diameter ends 48", 50" extending through bores 56", 52", with surrounding bevels 60" (one shown) on the cover wall 58 and base wall 54, respectively.

Spacing rings 76, 78, formed separately from, or as one piece with, the base wall 54, define bearing support surfaces 80, 84. Separate, cooperating, components 86, 88, with the latter a pivotable rotor, are mounted to the housing part 32. The component 86 is a strike plate that bears directly against the housing surface 68. The rotor 88 is moved guidingly against the bearing support surface 80. The latch element 22 is moved guidingly against the bearing support surface 84.

The rotor 88 has a body 90 with a mounting portion 92 and a receiving portion at 94 for the strike element 20. The mounting portion 92 of the body 90 has a through bore 96 to receive a reduced diameter portion 98 of the axle 42. An annular shoulder 100 between the reduced diameter portion 98 and a larger diameter portion 102 is spaced a distance D2 (FIG. 4) from the bearing support surface 80. The distance D2 is slightly greater than the thickness T1 (FIG. 3) of the body 90 of the rotor 88, between oppositely facing, generally flat, first and second surfaces bounding the body 90 and residing in substantially parallel, first and second reference planes P1, P2, so that the rotor 88 is confined against axial movement but will not bind with the housing 30 as it pivots in operation.

Figure 7:
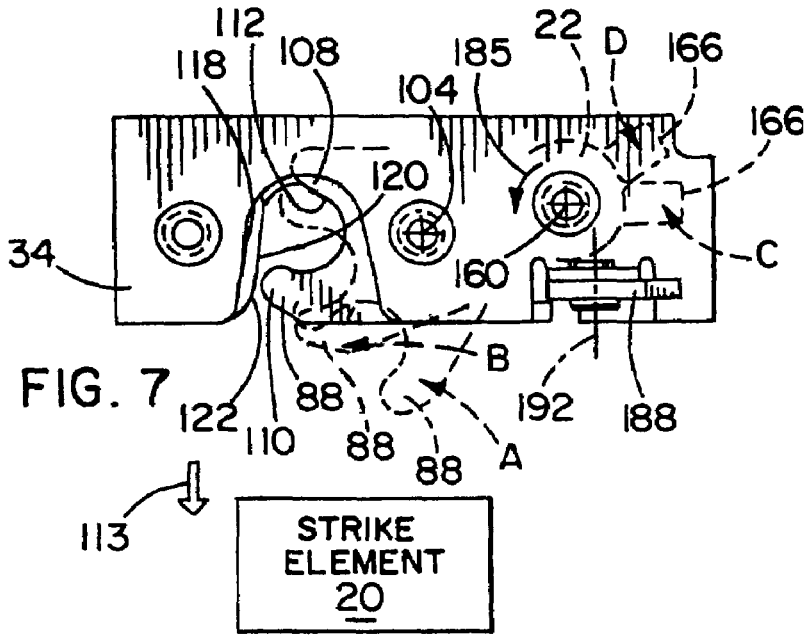
FIG. 7 is a view of the inventive latch assembly as in FIG. 5 and showing the rotor in second and third positions in phantom lines and showing the latch element in FIG. 1 in latched and release positions.
Figure 13:
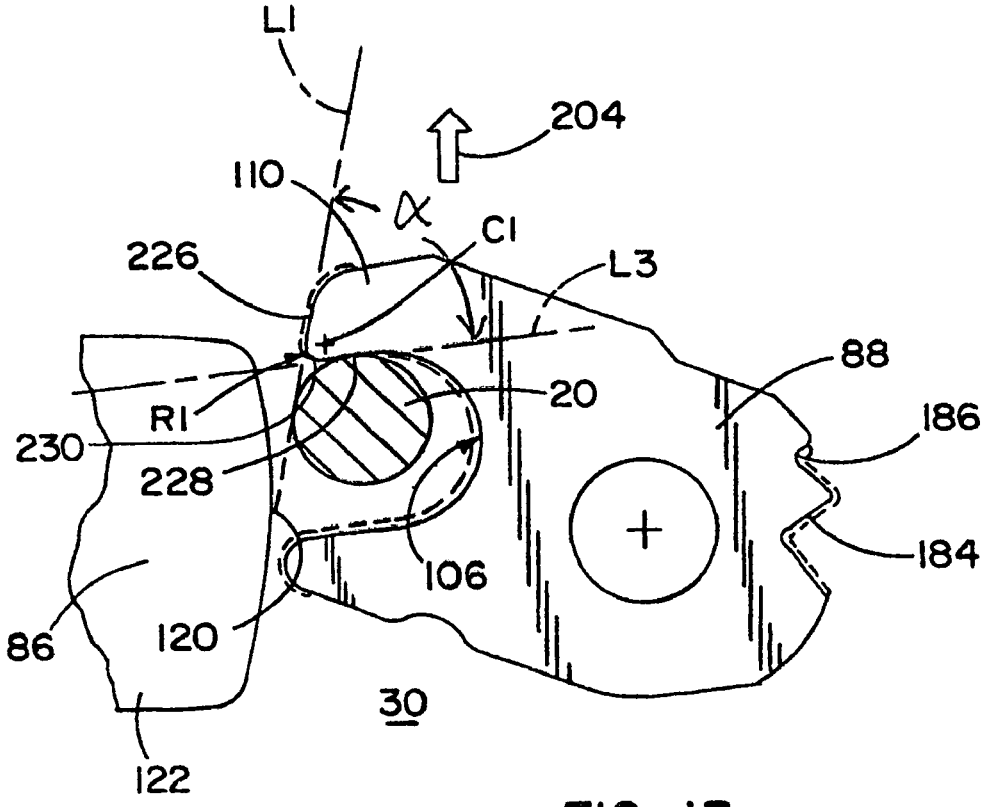
FIG. 13 is a view as in FIG. 10 with the rotor in a secondary latched position and the strike element in an in pocket state.

The reduced diameter portion 98 of the axle 42 is dimensioned to be closely received within the rotor bore 96 so as to guide pivoting movement of the rotor 88 about the axis 104 between a first, primary latched position, shown in FIGS. 2, 5, 6 and 7, and a second position, shown in dotted lines in FIG. 7 at A. The rotor has a third, secondary latched position, between the first and second rotor positions, as seen in FIG. 13, and in dotted lines in FIG. 7 at B.

The receiving portion 94 of the rotor 88 has an opening 106 which bifurcates the receiving portion 94 so as to define spaced legs 108, 110 between which a throat is defined to accept the strike element 20. The opening 106 is bounded by a U-shaped edge 112.

As seen in FIG. 7, with the rotor 88 in the second position therefor, and the repositionable element/closure 14 to which the latch assembly 16 is mounted in its first position, which may be an open position, movement of the repositionable element/closure 14 towards its second/closed position and towards the strike element 20, as indicated by the arrow 113, causes the strike element 20 to bear on the edge 112 on the leg 108. Continued movement of the repositionable element/closure 14 towards its second position causes the strike element 20 to pivot the rotor around the axis 104 fully into the first position for the rotor 88.

Figure 5:
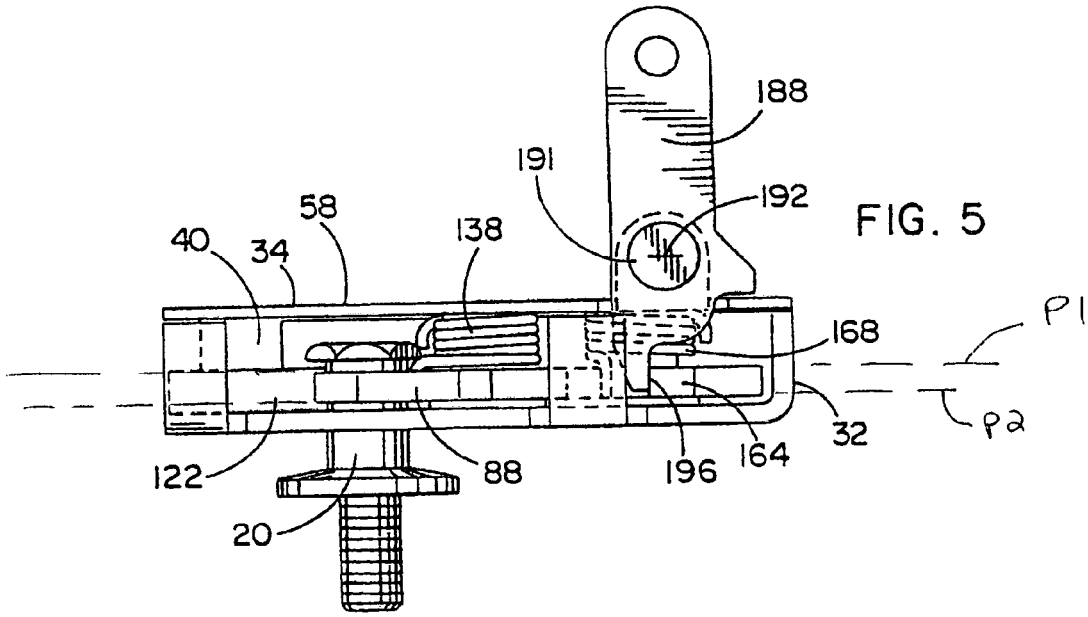
FIG. 5 is a side elevation view of the inventive latch assembly in the FIG. 2 state and with the strike element of FIG. 1 engaged by the rotor, with the rotor in its first position.
Figure 6:
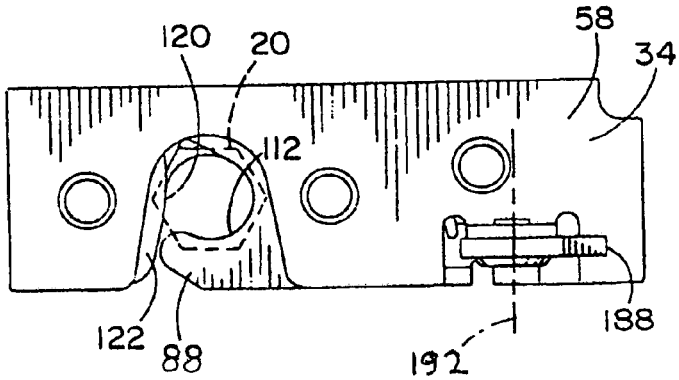
FIG. 6 is a plan view of the inventive latch assembly in the FIG. 5 state.

In the first position for the rotor 88, the strike element 20 within the rotor opening 106 resides fully within the width dimension of the housing 30. This is permitted by having U-shaped, coincident openings 116, 118 in the base wall 54 and cover wall 58, respectively. With the rotor 88 in the first position therefor, escape of the strike element 20 from the rotor opening 106 is blocked by a strike surface 120 on a strike plate 122, which projects across the rotor opening and resides in close proximity, or abuts, to one or more of the legs 108, 110 of the rotor 88. The surface 120 cooperates with the rotor 88 in a space between the planes P1, P2 (FIG. 5).

The strike plate 122 has a through bore 124 which receives a reduced diameter portion 98' of the axle 40. The strike plate 122 is keyed against movement around the axle 40 by a tab 126 which projects into a receptacle 128 through a side wall 130 on the housing part 32. Additional keying is afforded by a tab 132 defining part of an opposite side wall 134 which seats in an undercut 136 on the strike plate 122. In the first position for the rotor 88, the U-shaped edge 112 opens angularly towards the side wall 130.

The rotor 88 is normally biased towards its second position by a coiled torsion spring 138 which surrounds the larger diameter portion 102 of the axle 42. A first offset 140 on one cantilevered end arm 142 on the spring 138 bears against an edge 144 on a return wall 146, projecting from the side wall 130 towards the opposite side wall 134. A second offset 148 on an end arm 150 on the torsion spring 138 nests in a receptacle 152 on the rotor 88. The torsion spring 138 is loaded between the edge 144 on the return wall 146 and the edge bounding the receptacle 152 on the rotor 88 to bias the rotor 88 towards its second position. The second position for the rotor 88 is consistently maintained by the abutment of an edge 154 on the rotor 88 to a tab 156 that defines a part of the side wall 134.

The latch element 22 has a through bore 158 to accept a reduced diameter portion 98" of the axle 44, which guides movement of the latch element 22 around an axis 160 between a latched position, and a release position, shown in phantom lines in FIG. 7 at C and D, respectively. The latch element 122 has a latching arm 162, an operating arm 164, and a stop arm 166, each projecting radially from the axis 160 and spaced circumferentially therearound. The latch element 22 is normally biased into its latched position by a coiled torsion spring 168, with a first offset 170 on one cantilevered end arm 172, which nests in a receptacle 174 on the latch arm 162. A second offset 176 on a second cantilevered end arm 178 bears against a surface 180 of the side wall 130. The torsion spring 168 is loaded between the latch arm 162 and wall surface 180 to produce the desired operating torque on the latch element 22.

With the rotor 88 in the first position therefor, and the latch element in its latched position, the free end 182 on the latch element 22 abuts to an undercut stop surface 184 on the rotor 88 to maintain the rotor 88 in its first position. By pivoting the latch element 22 in the direction of the arrow 185 in FIG. 7, from its latched position at C towards its release position at D, the free end 182 clears the stop surface 184 to allow the rotor 88 to pivot under the torsion force from the spring 138 to a point that the free end 182 abuts a second stop surface 186 on the rotor 88 which is thereby maintained in the third position at B (FIG. 7), between the first and second positions, previously described. As earlier noted, the first rotor position represents a primary latched position, with the third position for the rotor 88 representing a secondary latched position for the rotor 88.

The latch element 22 is repositionable from its latched position into its release position through a release assembly, including a latch lever 188, which is mounted to an offset tab 190 on the cover wall 58 by a pin 191 for pivoting movement around an axis 192. Pivoting movement of the latch lever 188 in the direction of the arrow 194, around the axis 192, causes an actuating leg 196 to bear against the operating arm 164 on the latch element 22 to the point that the stop arm 166 bears against the wall surface 180, representing the release position for the latch element 22. As previously noted, the latch lever 188 can be repositioned either at the site of the latch lever 188, or remotely therefrom, by any type of operator 24, known to those skilled in the art or that might be readily devised by someone skilled in the art.

Figure 8:
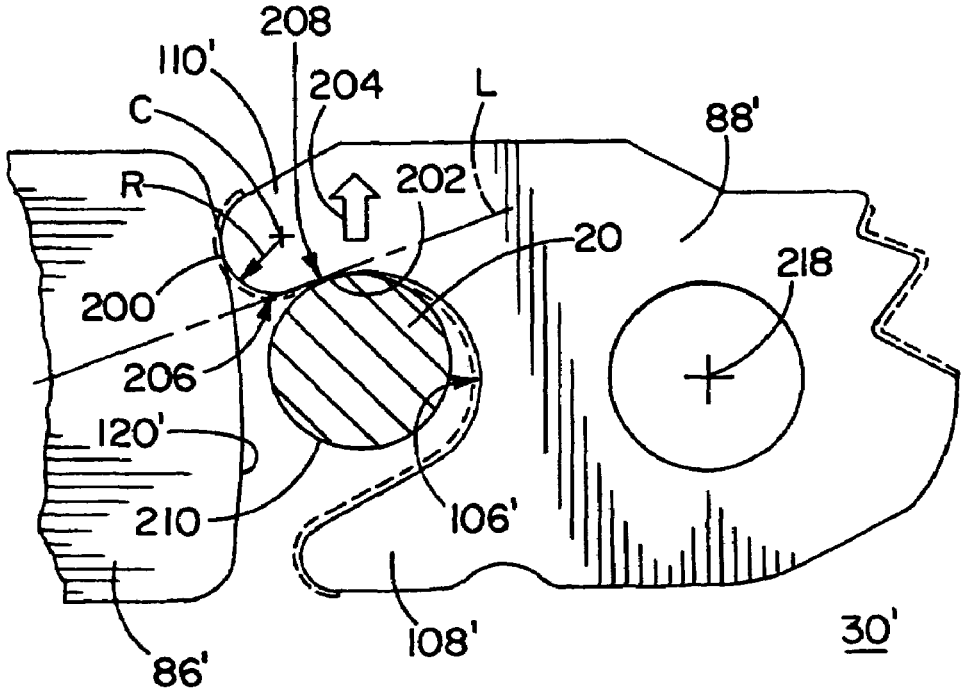
FIG. 8 PRIOR ART
FIG. 8 is a fragmentary, side elevation view of a conventional rotor and cooperating strike plate with the rotor in a primary latched position and a strike element held by the rotor in an in pocket state wherein the strike element bears on only the rotor.
Figure 9:
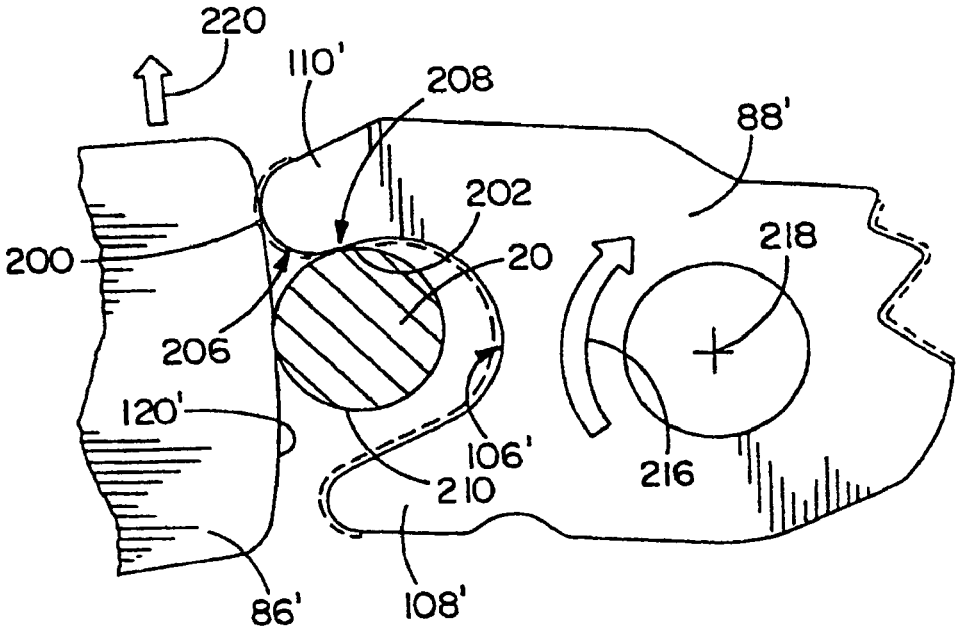
FIG. 9 PRIOR ART
FIG. 9 is a view corresponding to that in FIG. 8 showing the strike element in an out of pocket state wherein the strike element bears simultaneously on the rotor and strike plate.
Figure 11:
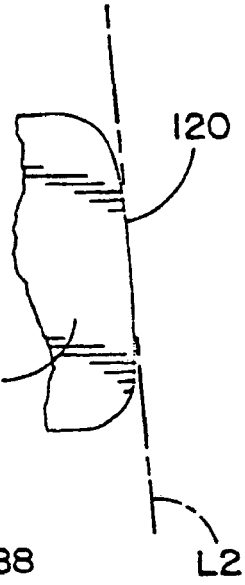
FIG. 11 is a fragmentary, side elevation view of the strike plate in FIG. 10 with a strike surface therein approximated by a straight reference line.
Figure 10:
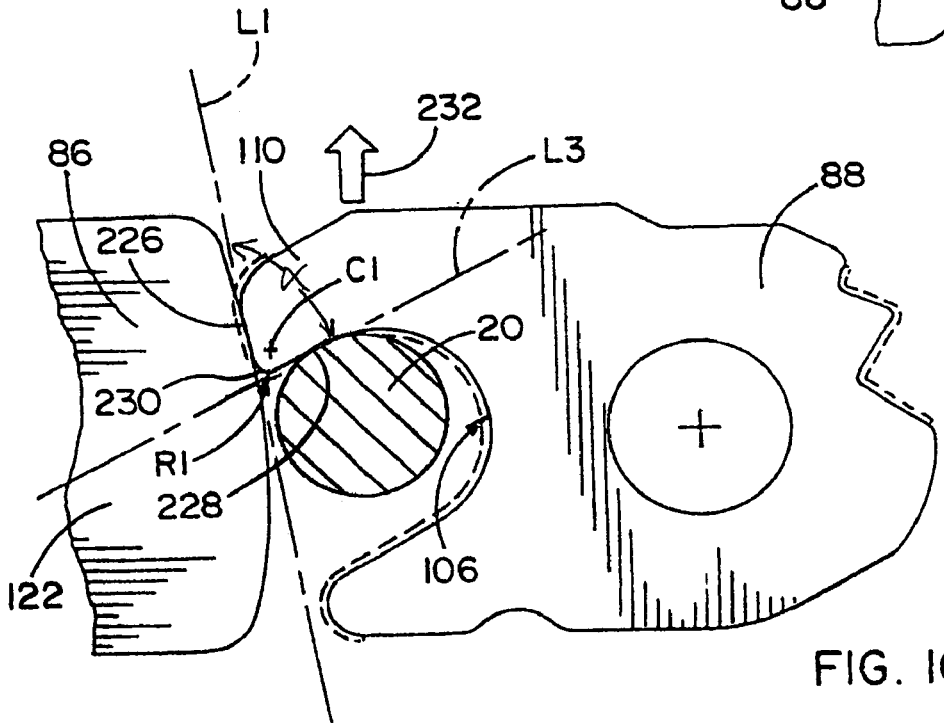
FIG. 10 is a view as in FIGS. 8 and 9 and showing a rotor, according to the present invention, in its first position with a strike element in an in pocket state.

The present invention is concerned primarily with the specific configuration of the rotor 88 and its cooperation with the strike plate 86, as shown in detail in FIGS. 10 and 11. Before describing the inventive rotor 88, a condition which the inventive rotor 88 is intended to avoid will be described with respect to a conventional rotor 88' and strike plate 86', as shown in FIGS. 8 and 9. The rotor 88' is mounted to a housing (not shown) for movement between a first position, as shown in FIGS. 8 and 9, and a second position, corresponding to that shown in phantom lines in FIG. 7 for the inventive rotor 88. As shown in FIG. 8, with the rotor 88' in its first position, the strike element 20 resides within the U-shaped opening 106', corresponding to the previously described opening 106 on the rotor 88. The U-shaped opening 106' is defined between spaced legs 108', 110', corresponding to the previously described legs 108, 110 on the rotor 88. The leg 110' has a different configuration than the leg 110 on the rotor 88, as previously described. The differences will be described in greater detail with respect to FIGS. 10 and 11, below. The remaining construction of the rotor 88' may be the same as, or similar to, that of the rotor 88, as described above.

With the rotor 88' in its first position, the leg 110' abuts, or is adjacent, to the strike surface 120', corresponding to the strike surface 120 on the strike plate 86, as previously described. The leg 110' has a confronting edge 200 which resides against, or is in close proximity to, the strike surface 120' with the rotor 88' in its first position. With the rotor 88', strike element 20, and strike plate 86' in the FIG. 8 state, attempted changing of the position of a closure element (not shown), with which the rotor 88' is associated, causes the strike element 20, carried by the closure element, to bear on an edge portion 202 on the leg 110' with a force exerted generally in the direction of the arrow 204 in FIG. 8.

In one embodiment, currently commercially offered by the assignee herein, the confronting edge 200 is defined by an arc of a circle centered on the point C. The arc has a radius R which is on the order of 0.125 inches. The confronting edge 200 blends into the edge portion 202 at a convexly radiused corner 206, which has the same radius R from the point C. The edge portion 202 has a portion at 208 which is substantially straight and projects generally along a reference line L in FIG. 8. In actuality, the portion 208 is slightly concavely curved to accept the convex peripheral surface 210 of the strike element 20. This produces a receptacle for the strike element 20 so that the strike element 20 does not slide freely towards the strike plate 86' and remains "in pocket", i.e. against only the rotor 88', as a force is applied in the direction of the arrow 204 through the strike element 20.

As the magnitude of the force applied by the strike element 20 on the rotor 88', in the direction of arrow 204, increases, ultimately the housing 30' with which the rotor 88' is associated begins to deflect/bend. This bending/deflection causes the rotor 88' to reposition by moving slightly in the direction of the arrow 216 around the mounting axis 218. As a consequence of this, the strike element 20 bears on the arm 110' closer to the free end of the arm 110'. By so doing, the strike element 20 encounters the arm edge with the radius R at the end of the edge portion 208, and eventually the corner 206. This action tends to wedge the rotor 88' further in the direction of the arrow 216 to the point that the strike element 20 slides against the corner 206 into engagement with the strike surface 120' so as to bear simultaneously against the rotor 88' and the strike surface 120'. This represents the "out of pocket" state for the strike element 20. With the rotor 88' out of pocket, the application of an increasing force on the rotor 88' and strike plate 86' through the strike element 20 causes a force to be applied in the direction of the arrow 204 to the strike plate 86', which causes the strike plate 86' to in turn deflect/bend the housing so that the strike plate 86' shifts out in the direction of the arrow 220 in FIG. 9.

In most constructions, the housing has a lesser ability to withstand an increasing loading force in the out of pocket state, shown in FIG. 9, than in the in pocket state, shown in FIG. 8. Eventually this condition causes the housing to bend/deflect to the point that the strike element 20 separates from between the rotor 88' and strike plate 86'. The rotor 88' and strike plate 86' do not appreciably, mutually stabilize their orientations by reason of there being only a tangential/point contact between the confronting edge 200 of the rotor 88' and the surface 120' of the strike plate 86'.

As seen in FIGS. 10 and 11, the inventive rotor 88 has a confronting edge 226 at the free end of the arm 110 that has a substantially straight extent along a line L1. The line L1 is substantially parallel to a reference line L2, which approximates the adjacent configuration of the strike plate surface 120. In actuality, the strike plate surface 120 is gradually convexly curved. However, the shape of this surface 120 can be approximated by the straight line L2.

The arm 110 has an edge portion 228 against which the strike element 20 bears, with the rotor 88 in the first position, that is straight or slightly concavely curved so that the extent of the edge portion 228 can be approximated by the reference line L3. The confronting edge 226 and arm portion 228 meet at a radiused corner at 230 having a surface that is approximated by an arc of a circle with a center C1 and having a radius R1, on the order of 0.032 inches. The lines L1, L3 define a corner angle $\propto$ of less than 90°. The radius R1 may vary, preferably in a range between 0.024 and 0.04 inches. With this configuration of the corner 230, the strike element 20 is allowed to slide into and out of the opening 106 without hanging up on the arm 110 in normal operation with the rotor 88 in the second position. At the same time, the corner 230 does not guide the strike element 20 to the out of pocket position as does the corresponding corner 206 and convexly curved end of the edge portion 208 on the prior art rotor 88' in FIGS. 8 and 9. That is, the housing 30 must be deformed to a greater extent for the strike element 20 to encounter the edge at the corner 230 on the rotor 88 than for the strike element 20 to encounter the edge portion 208 with the radius R that transitions into the corner 206 on the rotor 88. Thus, the strike element 20 does not wedge the rotor 88 in the same manner as it does the rotor 88' under the same force that will place the rotor 88' in the out of pocket state.

Accordingly, the strike element 20 has the capability of being in the in pocket position longer, as loading forces increase, with the configuration in FIG. 10 than with the configuration shown in FIGS. 8 and 9. At the same time, the engagement of the confronting edge 226 on the arm 110 and surface 120 on the strike element 86, over a substantial length thereof, potentially reinforces and stabilizes the relationship between the strike plate 86 and rotor 88 with the rotor 88 in the first position, as shown in FIG. 10. That is, the strike plate 86 and rotor 88 are mutually reinforcing in such a manner that, under the force of the strike element 20 in the direction of the arrow 232 in FIG. 10, they cooperate to produce a resistance to bending of the housing 30.

Figure 12:
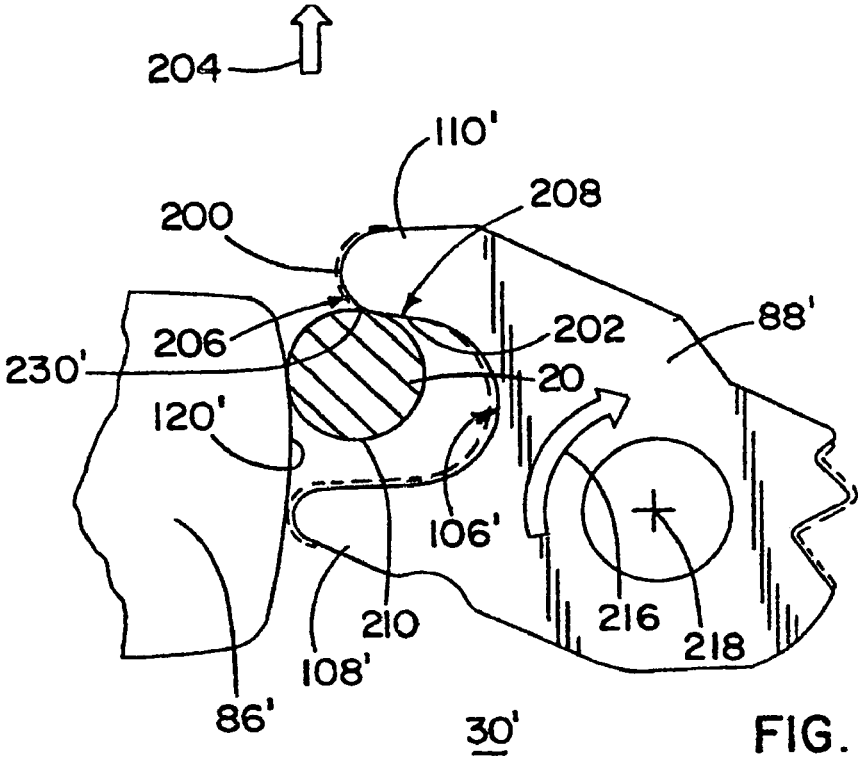
FIG. 12 (PRIOR ART)
FIG. 12 is a view as in FIGS. 8 and 9 with the rotor in a secondary latched position and the strike element in an out of pocket state.

The tendency of the strike element 20 to move into the out of pocket state is even greater in the prior art construction with the rotor 88' in a third, secondary latched position, as shown in FIG. 12, and corresponding to the third position for the rotor 88, as shown in phantom lines at B in FIG. 7 and in FIG. 13. With the rotor 88' in the third position of FIG. 12, the rotor 88' and strike plate surface 120' are intended to cooperate to prevent the strike element 20 from separating therefrom under a force exerted by the strike element 20 in the direction of the arrow 204. By reason of the rotor 88' pivoting in the direction of the arrow 216 around the axis 218 from the first position into the third position therefor, the strike element 20 becomes aligned closer to the confronting edge 200 at the free end of the rotor 88'. Any movement of the closure element, on which the rotor 88' and strike plate 86' reside, brings the strike element 20 into contact with rotor 88' at, or adjacent to, the radiused corner 206 before any deformation of the housing 30', to which the rotor 88' is mounted, occurs. As the force imparted to the rotor 88' by the strike element 20 increases to the point that the housing 30' begins to deform, the strike element 20 and corner 206 cooperate so that the application of a further increasing force causes the rotor 88' to be cammed in a manner to deflect the housing 30' to the point that the out of pocket state shown in FIG. 12 results. Since there is greater gap between the free end of the arm 110' and the strike plate surface 120' with the rotor 88' in the third position of FIG. 12 than in the first position therefor, as shown in FIG. 9, a lesser amount of deformation of the housing 30' is permitted to occur before this gap increases to the point that the strike element 20 can pass therethrough.

As seen with the inventive structure in FIG. 13, with the rotor 88 moved into the third, secondary latched position, repositioning of the associated closure element 14 will cause the strike element 20 to act closer to the free end of the arm 110, however still against the straight edge portion 228, rather than against the radiused corner 230. A substantial amount of deformation of the housing 30 may be required before the strike element 20 encounters the radiused corner 230.

Even at the stage that the strike element 20 encounters the corner 230, the inventive rotor 88 will produce a lesser wedging action than occurs with the rotor 88'. That is because the corner 230 has a smaller radius of curvature than the corner 230'. The smaller radius will have a smaller contact area with the strike element 20. The force of the corner 230 on the strike element 20 will be more localized than the force of the corner 230' on the strike element 20. The rotor will thus tend to hang up on the corner 230 so that it will not shift toward the out of pocket position until the force produced by the strike element 20 thereon is increased significantly.

Since the inventive rotor 88 functions similarly with the rotor in the first, primary latched and third, secondary latched positions therefor, the first position for the rotor, as recited in the claims herein, is intended to mean either the primary latched position or the secondary latched position therefor.

The foregoing disclosure of specific embodiments is intended to be illustrative of the broad concepts comprehended by the invention.

The invention claimed is:

1. A latch assembly comprising:

a housing; and a catch assembly on the housing and having first and second states, the catch assembly comprising a rotor that is movable selectively relative to the housing between first and second positions, the rotor having a mounting portion and a receiving portion and a thickness bounded by and between first and second substantially parallel reference planes, the receiving portion having a U-shaped opening between spaced first and second legs, the U-shaped opening configured to receive a strike element; and a strike plate having a strike surface with a portion that projects across the U-shaped opening in a space between the first and second reference planes in a manner so as to directly engage and thereby block a strike element in the U-shaped opening with the rotor in the first position and the catch assembly in the first state, the U-shaped opening bounded by an edge with a portion of the edge defined by the first leg against which a strike element within the U-shaped opening bears under a force tending to separate the latch assembly from the strike element, the portion of the edge having a first substantially straight length that extends to adjacent the strike surface portion with the rotor in the first position, the rotor in the second position with the catch assembly in the second state to allow a strike element in the U-shaped opening with the latch assembly in the first state to be separated from the latch assembly.

2. The latch assembly according to claim 1 wherein the strike surface extends along a reference line and the straight length of the edge portion is spaced from the reference line a distance not greater than 0.04 inches with the rotor in the first position.

3. The latch assembly according to claim 1 wherein the first leg defines a confronting edge which faces and is at or adjacent to the strike surface with the rotor in the first position, the confronting edge has a second substantially straight length and the first and second substantially straight lengths converge towards a corner.

4. The latch assembly according to claim 3 wherein the corner is convexly radiused.

5. The latch assembly according to claim 4 wherein the corner is defined by an arc of a circle having a radius of from 0.024-0.04 inches.

6. The latch assembly according to claim 5 wherein the radius of the arc is not greater than 0.032 inches.

7. The latch assembly according to claim 1 wherein the first leg has a confronting edge at or adjacent to the strike surface with the rotor in the first position and the confronting edge and the portion of the edge meet at a corner having a convex shape approximated by an arc of a circle having a radius that is substantially less than 0.125 inch.

8. The latch assembly according to claim 1 in combination with a repositionable element to which the latch assembly is attached, the repositionable element having a strike element thereon and movable between first and second positions relative to a support, and with the repositionable element in the first position, the latch assembly is in the first state and the strike element captively resides within the U-shaped opening.

9. The latch assembly according to claim 1 wherein the housing comprises first and second walls each having a U-shaped opening to receive a strike element and allow a strike element to reside in the U-shaped opening with the rotor in the first position, further wherein the strike plate is an element that is separate from the housing.

10. A latch assembly comprising:

a housing; and a catch assembly on the housing and having first and second states, the catch assembly comprising a rotor that is movable selectively relative to the housing between first and second positions, the rotor having a mounting portion and a receiving portion and a thickness bounded by and between first and second substantially parallel reference planes, the receiving portion having a U-shaped opening between spaced first and second legs, the U-shaped opening configured to receive a strike element; and a strike plate having a strike surface with a portion that projects across the U-shaped opening in a space between the first and second reference planes in a manner so as to block a strike element in the U-shaped opening with the rotor in the first position and the catch assembly in the first state, the U-shaped opening bounded by an edge with a portion of the edge defined by the first leg against which a strike element within the U-shaped opening bears under a force tending to separate the latch assembly from the strike element, the portion of the edge having a first substantially straight length that extends to adjacent the strike surface portion with the rotor in the first position, the rotor in the second position with the catch assembly in the second state to allow a strike element in the U-shaped opening with the latch assembly in the first state to be separated from the latch assembly, wherein the first leg defines a confronting edge which faces and is at or adjacent to the strike surface with the rotor in the first position, the confronting edge has a second substantially straight length and the first and second substantially straight lengths converge towards a corner, wherein the first leg is abuttable to the strike surface and the strike surface portion has a part that is substantially straight that is parallel to and abuts the confronting edge with the rotor in the first position and the catch assembly in the first state.

11. A latch assembly comprising:

a housing; and a catch assembly on the housing and having first and second states, the catch assembly comprising a rotor that is movable selectively relative to the housing between first and second positions, the rotor having a mounting portion and a receiving portion, the receiving portion having a U-shaped opening between spaced first and second legs, the U-shaped opening configured to receive a strike element; and a strike plate having a strike surface which projects across the U-shaped opening in a manner so as to directly engage and thereby block a strike element in the U-shaped opening with the rotor in the first position and the catch assembly in the first state, the U-shaped opening bounded by an edge with a portion of the edge defined by the first leg against which a strike element within the U-shaped opening bears under a force tending to separate the latch assembly from the strike element, the first leg having a confronting edge extending in a direction from the mounting portion up to or immediately adjacent the strike surface, but not beyond the strike surface, with the rotor in the first position, the portion of the edge and the confronting edge meet at a corner having a convex shape approximated by an arc of a circle having a radius that is substantially less than 0.125 inch, the rotor in the second position with the catch assembly in the second state to allow a strike element in the U-shaped opening with the latch assembly in the first state to be separated from the latch assembly, there being no part of the rotor that extends in a direction from the mounting portion towards and beyond the strike surface as the rotor is changed between its first and second positions.

12. The latch assembly according to claim 11 wherein the edge portion on the first leg has a straight part that extends to within 0.04 inches of the strike surface.

13. The latch assembly according to claim 11 wherein the confronting edge has a substantially straight length extending along a first line.

14. The latch assembly according to claim 11 wherein the convex shape of the corner is approximated by an arc of a circle having a radius that is not greater than 0.04 inches.

15. The latch assembly according to claim 11 wherein the convex shape of the corner is approximated by an arc of a circle having a radius that is in the range of 0.024-0.04 inches.

16. The latch assembly according to claim 11 wherein the convex shape of the corner is approximated by an arc of a circle having a radius that is approximately equal to 0.032 inches.

17. The latch assembly according to claim 11 in combination with a repositionable element to which the latch assembly is attached, the repositionable element having a strike element thereon and movable between first and second positions relative to a support, and with the repositionable element in the first position, the latch assembly is in the first state and the strike element captively resides within the U-shaped opening.

18. A latch assembly comprising:

a housing; and a catch assembly on the housing and having first and second states, the catch assembly comprising a rotor that is movable selectively relative to the housing between first and second positions, the rotor having a mounting portion and a receiving portion, the receiving portion having a U-shaped opening between spaced first and second legs, the U-shaped opening configured to receive a strike element; and a strike plate having a strike surface which projects across the U-shaped opening in a manner so as to block a strike element in the U-shaped opening with the rotor in the first position and the catch assembly in the first state, the U-shaped opening bounded by an edge with a portion of the edge defined by the first leg against which a strike element within the U-shaped opening bears under a force tending to separate the latch assembly from the strike element, the first leg having a confronting edge extending in a direction from the mounting portion up to or immediately adjacent the strike surface, but not beyond the strike surface, with the rotor in the first position, the portion of the edge and the confronting edge meet at a corner having a convex shape approximated by an arc of a circle having a radius that is substantially less than 0.125 inch, the rotor in the second position with the catch assembly in the second state to allow a strike element in the U-shaped opening with the latch assembly in the first state to be separated from the latch assembly, wherein the confronting edge has a substantially straight length extending along a first line, wherein the strike surface extends along a reference line and the first line is substantially parallel to the reference line and the straight length of the confronting edge is immediately adjacent to or against the strike surface where the strike surface extends along the reference line so that there is no gap between the confronting edge and strike surface into which a strike element might wedge with the rotor in its first position.

19. A latch assembly comprising:

a housing; and a catch assembly on the housing and having first and second states, the catch assembly comprising a rotor that is movable selectively relative to the housing between first and second positions, the rotor having a mounting portion and a receiving portion, the receiving portion having a U-shaped opening between spaced first and second legs, the U-shaped opening configured to receive a strike element; and a strike plate having a strike surface which projects across the U-shaped opening in a manner so as to directly engage and thereby block a strike element in the U-shaped opening with the rotor in the first position and the catch assembly in the first state, the U-shaped opening bounded by an edge with a portion of the edge defined by the first leg against which a strike element within the U-shaped opening bears under a force tending to separate the latch assembly from the strike element, the first leg having a confronting edge extending in a direction from the mounting portion up to or immediately adjacent the strike surface, but not beyond the strike surface, with the rotor in the first position, the portion of the edge and the confronting edge meet at a corner having a convex shape approximated by an arc of a circle having a radius that is substantially less than 0.125 inch, the rotor in the second position with the catch assembly in the second state to allow a strike element in the U-shaped opening with the latch assembly in the first state to be separated from the latch assembly, wherein the first leg is abuttable to the strike surface.

20. In combination:

a) a strike element; and b) a latch assembly comprising a housing and a strike plate with a strike surface, the rotor movable between: i) a first position to hold the strike element; ii) a second position to hold the strike element; and iii) a third position to allow separation of the strike element from the rotor, the rotor comprising:

a body with a mounting portion and a receiving portion, the receiving portion having first and second legs between which an opening is defined that is bounded by a U-shaped edge, the opening capable of receiving the strike element, the strike surface directly engagable with the strike element in the opening to prevent escape of the strike element from the opening, the U-shaped edge defined by an edge portion of the first leg, the first leg having a confronting edge which is positionable at or adjacent to a strike surface with the rotor in the first position, the portion of the edge and the confronting edge meet at a corner having a curved, convex shape approximated by a radius, there being no gap between the corner and the strike plate of a size that allows the strike element within the rotor opening to bear against the curved convex shape on the corner with the rotor in each of its first and second positions.

21. The combination according to claim 20 wherein the housing has first and second opposite side walls, the strike element moving from the first side wall towards the second side wall as the rotor is moved from its third position towards its first position, the edge portion has a substantially straight length that extends to the corner, the radius approximating the curved convex shape is substantially less than 0.125 inch and the U-shaped edge opens angularly toward the second side wall with the rotor in its first position.

22. The combination according to claim 21 wherein the confronting edge has a substantially straight length.

23. The combination according to claim 20 wherein the convex shape of the corner is approximated by an arc of a circle having a radius that is not greater than 0.04 inches.

24. The combination according to claim 20 wherein the convex shape of the corner is approximated by an arc of a circle having a radius that is in the range of 0.024-0.04 inches.

25. The combination according to claim 20 wherein the convex shape of the corner is approximated by an arc of a circle having a radius that is approximately equal to 0.032 inches.

26. A rotor for use in a latch assembly comprising:

a housing; and a catch assembly on the housing and having first and second states, the catch assembly comprising a rotor that is movable selectively relative to the housing between first and second positions, the rotor having a mounting portion and a receiving portion, the receiving portion having a U-shaped opening between spaced first and second legs, the U-shaped opening configured to receive a strike element; and a strike plate having a strike surface which projects across the U-shaped opening in a manner so as to directly engage and thereby block a strike element in the U-shaped opening with the rotor in the first position and the catch assembly in the first state, the U-shaped opening bounded by an edge with a portion of the edge defined by the first leg against which a strike element within the U-shaped opening bears under a force tending to separate the latch assembly from the strike element, the first leg having a confronting edge extending in a direction from the mounting portion up to or immediately adjacent the strike surface, but not beyond the strike surface, with the rotor in the first position, the portion of the edge and the confronting edge meet at a corner having a convex shape approximated by an arc of a circle having a radius that is substantially less than 0.125 inch, the rotor in the second position with the catch assembly in the second state to allow a strike element in the U-shaped opening with the latch assembly in the first state to be separated from the latch assembly, wherein the rotor has a thickness bounded by and between first and second substantially parallel reference planes and the strike surface has a portion that projects across the U-shaped opening in a space between the first and second reference planes in a manner so as to block a strike element in the U-shaped opening with the rotor in the first position and the catch assembly in the first state.

27. Rotor for use in a latch assembly having a housing and a strike plate with a strike surface, the rotor movable between first and second position to respectively hold a strike element and allow separation of a strike element from the rotor, the rotor comprising:

a body with a mounting portion and a receiving portion, the receiving portion having first and second legs between which an opening is defined that is bounded by a U-shaped edge, the opening capable of receiving a strike element, the strike surface directly engagable with a strike element in the opening to prevent escape of the strike element from the opening, the U-shaped edge defined by an edge portion of the first leg, the first leg having a confronting edge which is positionable at or adjacent to a strike surface with the rotor in the first position, the portion of the edge and the confronting edge meet at a corner having a curved, convex shape approximated by a radius that is substantially less than 0.125 inch there being no appreciable gap between the corner and the strike plate with the rotor in its first position, wherein the edge portion has a substantially straight length that extends to the corner, wherein the confronting edge has a substantially straight length, wherein the substantially straight lengths bound a corner angle that is less than 90°.

28. A rotor for use in a latch assembly comprising:

a housing; and a catch assembly on the housing and having first and second states, the catch assembly comprising a rotor that is movable selectively relative to the housing between first and second positions, the rotor having a mounting portion and a receiving portion, the receiving portion having a U-shaped opening between spaced first and second legs, the U-shaped opening configured to receive a strike element; and a strike plate having a strike surface which projects across the U-shaped opening in a manner so as to directly engage and thereby block a strike element in the U-shaped opening with the rotor in the first position and the catch assembly in the first state, the U-shaped opening bounded by an edge with a portion of the edge defined by the first leg against which a strike element within the U-shaped opening bears under a force tending to separate the latch assembly from the strike element, the first leg having a confronting edge extending in a direction from the mounting portion up to or immediately adjacent the strike surface, but not beyond the strike surface, with the rotor in the first position, the portion of the edge and the confronting edge meet at a corner having a convex shape approximated by an arc of a circle having a radius that is substantially less than 0.125 inch, the rotor in the second position with the catch assembly in the second state to allow a strike element in the U-shaped opening with the latch assembly in the first state to be separated from the latch assembly, the housing comprising first and second walls each having a U-shaped opening to receive a strike element and allow a strike element to reside in the U-shaped opening with the rotor in the first position, wherein the strike plate is an element that is separate from the housing.

29. A rotor for use in a latch assembly having a housing and a strike plate with a strike surface, the rotor movable between first and second position to respectively hold a strike element and allow separation of a strike element from the rotor, the rotor comprising:

a body with a mounting portion and a receiving portion, the receiving portion having first and second legs between which an opening is defined that is bounded by a U-shaped edge, the opening capable of receiving a strike element, the strike surface directly engagable with a strike element in the opening to prevent escape of the strike element from the opening, the U-shaped edge defined by an edge portion of the first leg, the first leg having a confronting edge which is positionable at or adjacent to a strike surface with the rotor in the first position, the portion of the edge and the confronting edge meet at a corner having a curved, convex shape approximated by a radius that is substantially less than 0.125 inch, there being no appreciable gap between the corner and the strike plate with the rotor in its first position, the housing comprising first and second walls each having a U-shaped opening to receive a strike element and allow a strike element to reside in the U-shaped opening with the rotor in the first position, wherein the strike plate is an element that is separate from the housing.

30. In combination:

a) a strike element; and b) a latch assembly comprising a housing and a strike plate with a strike surface, the rotor movable between first and second position to respectively hold the strike element and allow separation of the strike element from the rotor, the rotor comprising:

a body with a mounting portion and a receiving portion, the receiving portion having first and second legs between which an opening is defined that is bounded by a U-shaped edge, the opening capable of receiving the strike element, the strike surface directly engagable with a the strike element in the opening to prevent escape of the strike element from the opening, the U-shaped edge defined by an edge portion of the first leg, the first leg having a confronting edge which is positionable at or adjacent to a strike surface with the rotor in the first position, the portion of the edge and the confronting edge meet at a corner having a curved, convex shape approximated by a radius, there being no gap between the corner and the strike plate of a size that allows the strike element within the rotor opening to bear against the curved convex shape on the corner with the rotor in its first position, wherein the rotor has a thickness bounded by and between first and second substantially parallel reference planes and the strike surface has a portion that projects across the U-shaped opening in a space between the first and second reference planes in a manner so as to block a strike element in the U-shaped opening with the rotor in the first position and the catch assembly in the first state.

* * * * *